United States Patent [19]

Hyde et al.

[11] Patent Number: 4,588,509

[45] Date of Patent: May 13, 1986

[54] PROPPANT CONCENTRATOR

[75] Inventors: Patrick C. Hyde; Van C. Burroughs, both of Fort Worth, Tex.

[73] Assignee: The Western Company of North America, Fort Worth, Tex.

[21] Appl. No.: 581,342

[22] Filed: Feb. 17, 1984

[51] Int. Cl.[4] ..... B04C 1/00

[52] U.S. Cl. ..... 210/788; 210/806; 210/512.1

[58] Field of Search ..... 210/740, 788, 806, 512.1, 210/512.3; 55/309-311

[56] References Cited

U.S. PATENT DOCUMENTS

| | | | |
|---|---|---|---|
| 2,084,958 | 6/1937 | Hunter | 210/512.1 |
| 2,191,190 | 2/1940 | DeGuire | 210/512.1 |
| 3,988,239 | 10/1976 | Mazina | 210/512.1 |
| 4,126,181 | 11/1978 | Black | 166/280 |
| 4,354,552 | 10/1982 | Zingg | 210/512.1 |
| 4,448,709 | 5/1984 | Bullen | 210/512.1 |

*Primary Examiner*—John Adee

*Attorney, Agent, or Firm*—Richards, Harris, Medlock & Andrews

[57] ABSTRACT

An apparatus (10) for concentrating the level of a proppant in a slurry under pressure includes a cyclone chamber (22) having a reduced diameter end with an exhaust outlet (40) therein. A slurry and proppant mixture is introduced under pressure into the chamber at an inlet (120) substantially along a path tangential to the side wall of the chamber. Flow of fluid into the cyclone chamber causes the slurry and proppant mixture to follow a spiraled path toward the exhaust outlet such that the heavier constituents in the mixture move near the inside wall of the chamber. A reflux tube (140) is positioned within the chamber and permits the removal of fluid from the low proppant concentration area of the fluid chamber and directs the fluid across a choke (90, 90') and to a deenergizer (94, 94'). The deenergizer includes a housing having an inner longitudinal tube (184) with an inlet (180) for receiving fluid from the cyclone chamber and a closed end opposite the inlet. The inner tube has a plurality of apertures (190) therethrough, the apertures being positioned closer to the inlet end than to the closed end. An outer sleeve (154) surrounds the inner tube to define an annular chamber (200) therebetween. The outer sleeve also has an outlet (220) positioned remote from the apertures. Baffles (202, 204, 206) are mounted in the annular chamber.

29 Claims, 5 Drawing Figures

FIG. 3
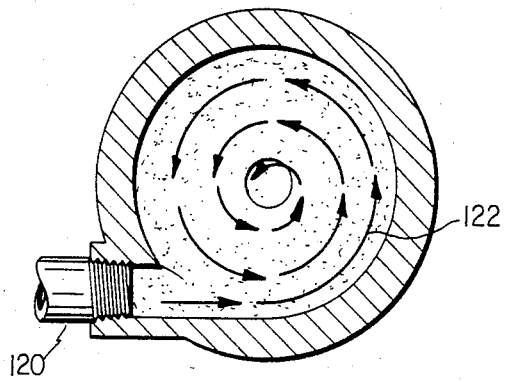
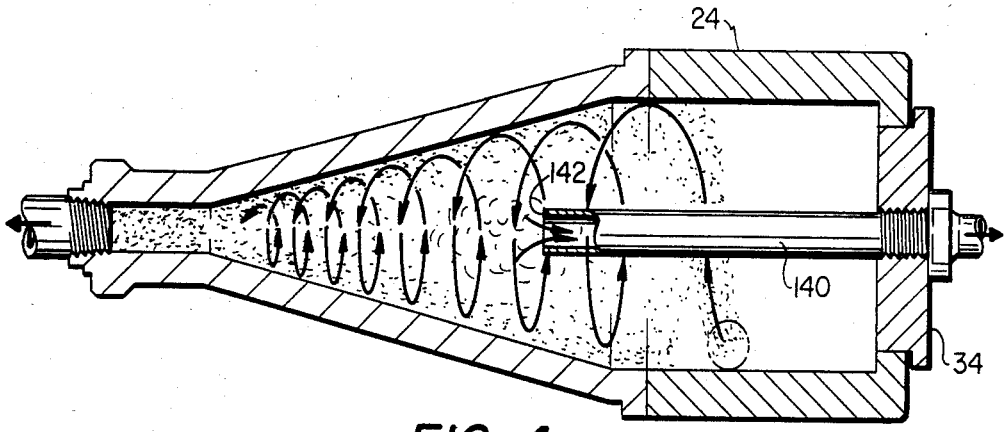
FIG. 4

PROPPANT CONCENTRATOR

TECHNICAL FIELD

The present invention relates to an apparatus for concentrating the level of a proppant in a fluid, and particularly to concentrating the level of a proppant in fluid under high pressures.

BACKGROUND ART

In the production of oil from subsurface formations, it is often necessary to stimulate production by hydraulically fracturing the formations with various mixtures. These mixtures may contain any number of ingredients including selected portions of sand, polymers and other chemicals added to water to form a slurry mixture for injection into the well. The hydraulic pressure applied to such formations creates tensile stresses in the rock of the formation resulting in fracturing or parting of the rock. These fractures are then filled by the injection of slurries containing propping agents under high pressure. Upon release of the pressure, the propping agent deposited in the fracture prevents the fractures from closing leaving channels through which oil and oil bearing fluids may flow to the well bore.

The concentration of the propping agent in the slurry is critical in that insufficient propping agent may not sufficiently maintain the fractures open and thus not provide full flow of oil and oil bearing fluids to the well bore. Use of excessive propping agent in the slurry may hinder the movement of the mixture into the formation and thus limit its effectiveness. Although devices have been designed to increase the concentration of the propping agent in fracturing fluid, including those disclosed in U.S. Pat. No. 4,126,181 to Black, and U.S. Pat. No. 4,354,552 to Zingg, these systems have not been well adapted to use where high fluid velocities are encountered in the proppant concentration process.

Thus, the need has arisen for an apparatus for concentrating the level of proppant in a fracturing fluid where such fracturing fluid is being injected into the well at high pressure and where high fluid velocities are encountered in the concentration of proppant in the fluid.

DISCLOSURE OF THE INVENTION

The present invention is to an apparatus for concentrating the level of a proppant in a fluid under pressure. The apparatus includes a chamber having a generally cylindrical first section and a conical section attached therefrom. The conical section has a reduced diameter end with a discharge therein and an inlet for introducing a fluid and proppant mixture, under pressure, into the chamber substantially along a path tangential to the sidewall of the chamber.

In a preferred embodiment, the fluid is introduced into the chamber out of the plane of but at an acute angle to the central longitudinal axis of the chamber. A fluid discharge is attached to the reduced diameter end of the conical section and a fluid extraction, or reflux, line is attached substantially in line with but at the opposite end of the chamber. This reflux line communicates with a deenergizer, or energy absorbing unit, and a choke is positioned in the line between the chamber and the deenergizer.

The deenergizer includes a housing having an inner longitudinal tube with an inlet for receiving fluid therein and a closed end opposite the inlet. The inner tube has a plurality of apertures therethrough which are positioned closer to the inlet end than to the closed end. An outer sleeve surrounds the inner tube to define an annular chamber between the inner tube and outer sleeve. The annular chamber is in fluid communication with the apertures through the inner tube. The outer sleeve has an outlet therein which is remote from the apertures in the inner tube. A plurality of baffles are positioned in the annular chamber between the inner and outer tube and in the flowpath between the apertures in the inner tube and the outlet of the outer sleeve.

In a preferred embodiment, the inlet tube is concentric within the outer sleeve, and the outlet of the outer tube is adjacent the closed end of the inner tube. The apertures in the inner tube include a plurality of openings therethrough which are equally spaced around the inner tube. The baffles include a plurality of plates mounted around the inner tube and within the annular chamber between the inner tube and the outer sleeve with the plates having a plurality of apertures substantially equally spaced around the inner tube.

In a further embodiment of the present invention, the fluid reflux line feeds a manifold which, through valving, is connected to a a pair of deenergizer structures. Through the control of such valving, the flow through the reflux line may be directed to a selected one deenergizer or may be directed to both, depending upon the energy dissipation needed. Further, valving on the reflux line permits control of the amount of fluid which is drawn from the conical chamber.

BRIEF DESCRIPTION OF THE DRAWINGS

For a more complete understanding of the present invention, and for further details and advantages thereof, reference is now made to the following detailed description taken in conjunction with the accompanying drawings, in which:

FIG. 3 is a section view taken along lines 3—3 of FIG. 1;

FIG. 4 is a section view taken along line 4—4 of FIG. 1; and

DETAILED DESCRIPTION

Figure 1:
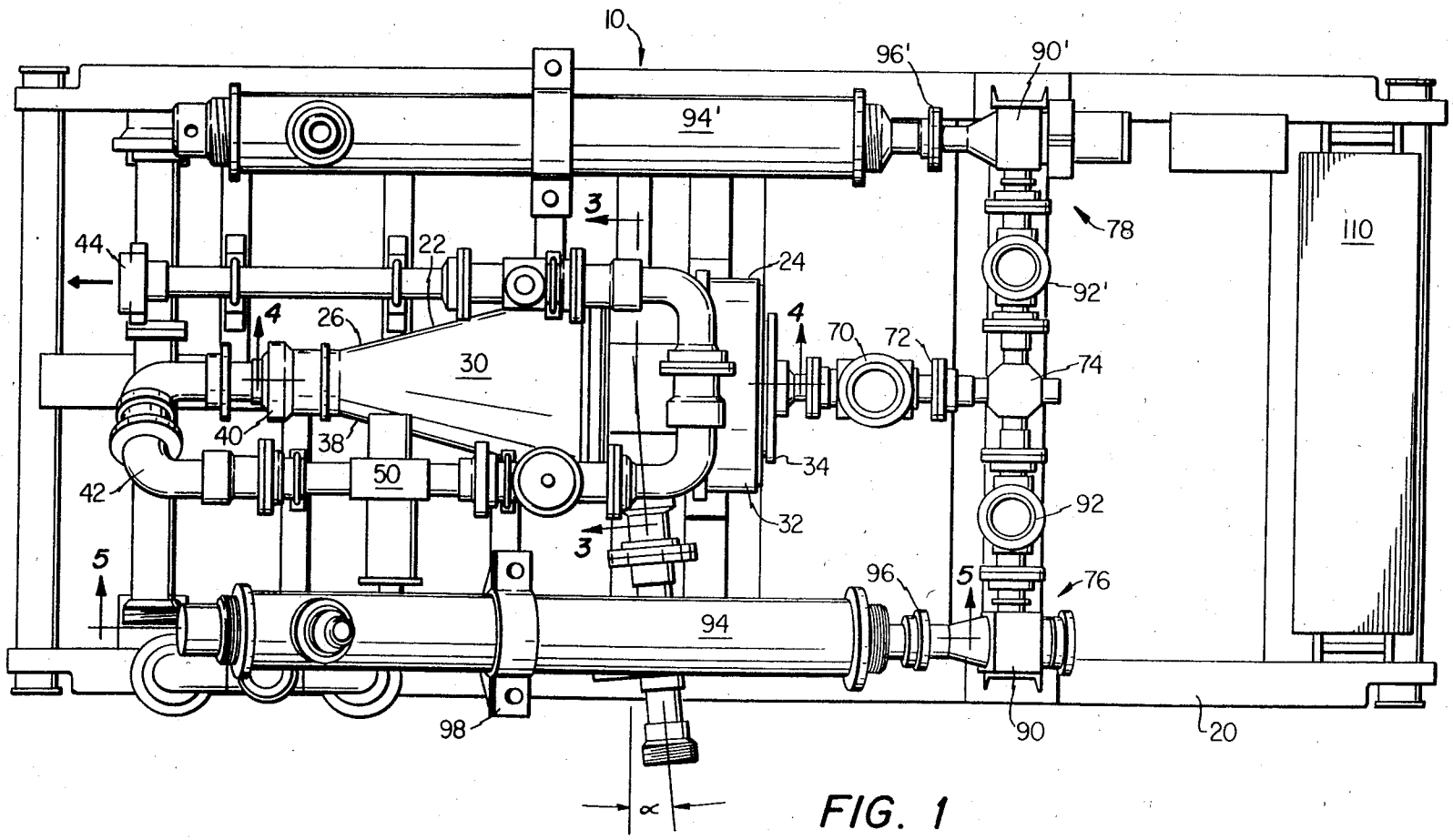
FIG. 1 is a plan view of the concentrator of the present invention.
Figure 2:
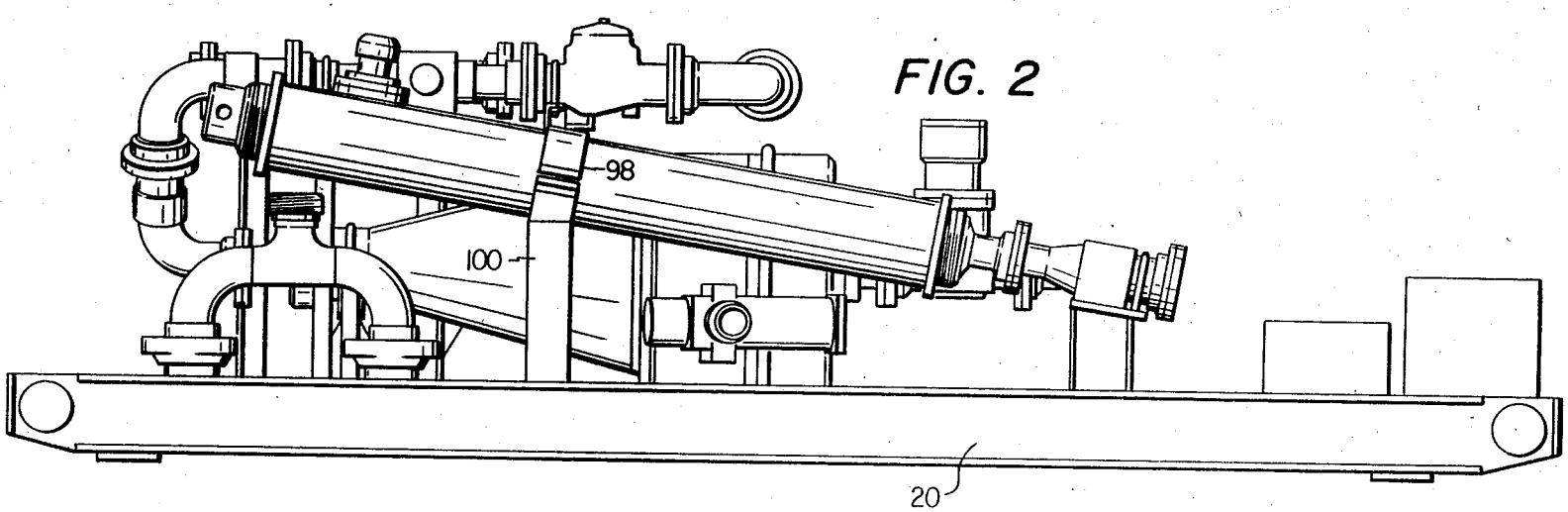
FIG. 2 is a side view thereof.

Referring now to the drawings, FIGS. 1 and 2 disclose an apparatus 10 supported on a frame 20 for concentrating the level of a proppant in a slurry under pressure. The apparatus includes a cyclone chamber 22 having a substantially cylindrical large end 24 and a conical section 26 extending from cylindrical section. Cylindrical and conical sections 24 and 26, respectively, define an inner chamber 30. Cylindrical section 24 includes a substantially cylindrical side wall 32 and an end wall 34. Conical section 26 includes a conical side wall 38 and a proppant and fluid mixture discharge outlet 40 at the small end of the conical side wall. A discharge manifold 42 is attached to discharge outlet 40 and has a end coupler 44 for attachment to appropriate tubing to provide for the injection of the proppant and slurry mixture into the well formation.

Discharge manifold 42 includes a plurality of valves and couplings common to oil well service. A densiometer 50 is installed to measure the effectiveness of the concentrator.

A hydraulically actuated plug valve 70 is attached from end wall 34 of cylindrical section 24 of the cyclone chamber. Valve 70 is connected to a tee section 74, and substantially identical choke and deenergizer assemblies 76 and 78 are attached from tee 74. Assembly 76 includes a choke 90 connected from tee 74 with a plug valve 92 mounted therebetween. A deenergizer assembly 94 is attached to choke 90 using an appropriate fitting 96. Similarly, assembly 78 includes an adjustable choke 90' connected from tee 74 with a manual plug valve 92' therebetween. A deenergizer assembly 94' is attached to choke 90' using fitting 96'. Deenergizer 94 is mounted from frame 20 using an appropriate clamp and support 98 and 100.

Referring still to FIG. 1 in conjunction with FIG. 2, a remote control unit 110 is mounted to one end of frame 20 and controls valve 70 and choke 90' be described hereinafter in greater detail.

Controller 110 may be of one of any remote controllers produced for the purpose of controlling plug type valves such as the controller manufactured by Sperry Vickers, Troy, Mich.

Cyclone chamber 22 is disclosed in the section views of FIGS. 3 and 4. Referring to these figures, an inlet tube 120 is mounted to cylindrical section 24 of cyclone chamber 22. As can be seen in FIG. 3, inlet tube 120 has its longitudinal axis substantially tangential to cylindrical section 24. The flow of proppant mixture injected into chamber 22 by inlet tube 120 follows the circumferential and spiraled path represented by arrows 122 of FIGS. 3 and 4. As can be seen in FIG. 1, inlet 120 is also positioned at an angle $\alpha$ from the perpendicular to the longitudinal axis of the cyclone chamber. For successful operation, this angle $\alpha$ will be varied depending upon the dynamics of the fluids and proppants involved. In one embodiment of the invention, this angle is on the order of 6°.

By directing the flow toward the conical end of the cylone, the fluid injected into the chamber will follow a spiraling path along the chamber wall into the conical section 26 to be discharged through discharge outlet 40 and into discharge manifold 42. The heavier constituents of the mixture move radially outwardly toward the chamber wall under centrifugal force and continue spiraling adjacent the wall. Lighter constituents, with lesser specific gravity, will occupy the central area of the cylindrical section and the conical section of the cylone chamber 22. As can be seen in FIG. 4, a reflux line 140 is positioned within the cylone chamber, through wall 34, with its end 142 positioned in this region. Thus, fluid with lighter constituents, or devoid of substantially all the proppant within the fluid, is withdrawn from chamber 22 through tube 140 past valve 70 and into assembly 76 or 78, or both.

Pressure in cyclone chamber 22 will be the surface treating pressure which is applied to the well at surface connections. Although this treating pressure will vary depending upon the formation being treated, the fracturing fluid and mixture being used, in many deep wells, pressures on the order of 10,000–15,000 psi will be required. This high pressure is communicated through valves 92 and 92' and chokes 90 and 90' to deenergizers 94 and 94', respectively.

Figure 5:
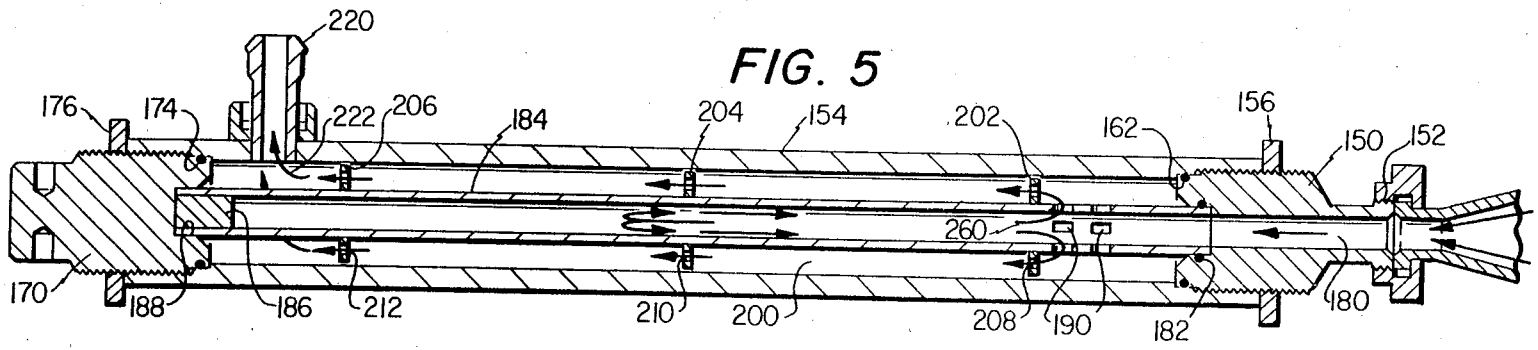
FIG. 5 is a section view taken along line 5—5 of FIG. 1.

Referring to FIG. 5 wherein the deenergizer 94 is shown in section view, the deenergizer includes an inlet manifold fitting 150 having a threaded end 152 for attachment to choke 90 by way of fitting 96. An outer sleeve 154 is threadedly received onto fitting 150 and a lock nut 156 is received on fitting 150 for securing outer sleeve 154 thereto. Fitting 150 has an annular groove at its end for receiving a seal 162 therein for sealing between fitting 150 and outer sleeve 154. The end of outer sleeve 154 remote from fitting 150 is threaded to receive an end plug 170. Plug 170 has an annular groove for receiving a seal 174 for sealing between plug 170 and sleeve 154. A lock nut 176 is also received onto plug 170 for engagement against the end wall of sleeve 154.

Fitting 150 has a fluid path 180 formed therethrough and a concentric bore 182 for receiving one end of an inner tube 184 therein. The opposite end of tube 184 has a plug 186 therein and is received in a bore 188 formed in end plug 170. As can be seen in FIG. 5, tube 184 is sealingly supported in place between fitting 150 and end plug 170. Engagement of tube 184 between fittings 150 and 170 is accomplished by threading these fittings into outer sleeve 154 as needed to engage tube 184.

A plurality of apertures 190 are cut in inner tube 184 at spacings of approximately 90° apart. These apertures are positioned nearer to the forward end of the deenergizer 94 than to the rearward end, that is, these apertures are closer to fitting 150 than to end plug 170. An annular chamber 200 is defined between inner tube 184 and sleeve 154 bounded at the forward end by fitting 150 and at the rearward end by end plug 170. Baffle plates 202, 204 and 206, each having a plurality of apertures 208, 210 and 212 formed about the circumference thereof, extend into the annular chamber 200. At outlet 220 communicates with annular chamber 200 through outer sleeve 154 at an aperture 222 through the sleeve. Aperture 222 is formed in sleeve 154 at the end of the deenergizer remote from inlet fitting 150 and apertures 190.

In operation of the present invention, a slurry mixture and proppant is injected into the cyclone chamber 22 through inlet 120. The proppant and slurry mixture will normally be injected at a rate of from 5 to 30 barrels per minute and have a proppant specific gravity of 2.6–4.0. It will be appreciated that these are only suggested ranges and the present invention may be used to handle higher rates and proppant mixtures including a proppant having a higher or lower specific gravity. As the fluid is injected into the cyclone chamber 22, it follows a spiraling path which is directed into the conical section for discharge through discharge outlet 40. The angular acceleration of the fluid causes the more dense particles, such as the proppant in the slurry mixture, to move radially outwardly toward the chamber wall. The lighter constituents occupy the central zone within the chamber and are removed from the chamber through reflux tube 140. Hydraulically actuated plug valve 70 is normally opened, its position being controlled remotely by remote control unit 110. This fluid, under the same working pressure as the fluid being discharged through outlet 40, then is directed past plug valves 92 or 92' and through chokes 90 or 90'. By controlling the position of valves 92 and 92', flow may be directed to either one or both of the deenergizers 94 or 94' as needed.

A pressure drop occurs across choke valves 90 and 90'; and the potential energy in the fluid is converted to kinetic energy. Deenergizers 94 and 94' are designed to dissipate this kinetic energy prior to permitting the discharge of the fluid from outlet 220. Referring to FIG. 5, fluid, at a high velocity, is injected into fitting 150 and inner tube 184 of the deenergizer. Given the velocity at which the fluid enters tube 184, movement of the fluid is into tube 184 beyond apertures 190. The fluid, in effect, acts on itself to dissipate the kinetic energy contained therein. The fluid then follows the path of movement indicated by arrows 260 and moves through apertures 190 and apertures 208, 210 and 212 in baffle plates 202, 204 and 206, respectively, before discharge through outlet 220. The kinetic energy of the fluid is also dissipated by movement of the fluid through and beyond the baffle plates in annular chamber 200. Thus, although the fluid enters the deenergizer at a high velocity, it is dispelled through outlet 220 at a much lower velocity by virtue of the dissipation of energy provided by the deenergizer. The present invention provides for the control of the high velocity fluid discharged through chokes 90 and 90' such that the fluid may be safely and conveniently handled upon discharge from the deenergizers.

The invention further provides for dual chokes connected to identical deenergizer units, one of the chokes being remotely adjustable by hydraulic control. In the event one choke or deenergizer is unserviceable for any reason, the system has a backup unit. Further, chokes of different sizes may be incorporated in choke assemblies 90 and 90' such that they may be selectively used as required in the system. Additionally, the use of both chokes with the corresponding deenergizer units may be used where needed.

Although the present invention has been described as used for concentrating a proppant in a slurry by withdrawing a portion of the slurry fluid from the system, the invention also has application to the separation of materials. The system may be used to separate any two liquids of dissimilar specific gravities or liquids and solids having dissimilar specific gravities. In using the invention for separating liquids or liquids from solids, the material or higher specific gravity will be discharged from the cyclone chamber through exhaust 40 while material of lesser specific gravity will be removed through reflux tube 140 for discharge through deenergizers 94 and 94'.

Because separation may be accomplished without reducing the pressure of the fluid moving through the cyclone chamber, the present systems may be used at high pressure points in a system. For example, where a coal slurry is to be separated from its carrier, this separation can be accomplished at a point in the process cycle at elevated pressures. This is highly advantageous where, for example, the materials are under pressure for purposes of movement through a pipeline or where separation is required in the process cycle where the materials being separated are at elevated pressures.

Although preferred embodiments of the invention have been described in the foregoing detailed description and illustrated in the accompanying drawings, it will be understood that the invention is not limited to the embodiments disclosed, but is capable of numerous rearrangements, modifications, and substitutions of parts and elements without departing from the spirit of the invention. The present invention is therefore intended to encompass such rearrangements, modifications and substitutions of parts and elements as fall within the scope of the invention.

We claim:

1. An apparatus for concentrating the level of a proppant in a fluid under pressure comprising:

a conical chamber having a reduced diameter end with a discharge therein and an inlet for introducing a fluid and proppant mixture under pressure into said chamber substantially along a path tangential to the side wall of the chamber, fluid extraction means comprising a reflux tube having one end positioned within said conical chamber for receiving fluid from said chamber and a second end communiating with a choke means for maintaining the pressure of the fluid upstream, said choke means effecting a pressure drop thereacross, and energy absorber means for receiving said fluid removed from said fluid chamber and for dissipating the kinetic energy of said fluid prior to discharging said fluid from said absorber means, said absorber means comprising a housing having an inner chamber with an inlet for receiving fluid therein and a closed end opposite said inlet, said inner chamber having an aperture therethrough, said aperture being positioned remote from the closed end, and an outer chamber surrounding said inner chamber to define an annular space therebetween and having an outlet therein remote from said aperture in the said inner chamber.

2. The apparatus according to claim 1 wherein said energy absorber means comprises:

a housing having an inner longitudinal tube with an inlet for receiving fluid therein and a closed end opposite said inlet, said inner tube having a plurality of apertures therethrough, said apertures being positioned closer to the inlet end than to said closed end, and an outer sleeve surrounding said inner tube to define an annular chamber therebetween and having an outlet therein remote from said apertures in said inner tube.

3. The apparatus according to claim 2 wherein said inner tube is concentric within said outer sleeve and wherein the outlet in said outer sleeve is adjacent the closed end of said inner tube.

4. The apparatus according to claim 2 wherein said apertures in said inner tube are formed adjacent the inlet of said inner tube and include a plurality of apertures spaced radially around said inner tube.

5. An apparatus for concentrating the level of a proppant in a fluid under pressure comprising:

a conical chamber having a reduced diameter end with a discharge therein and an inlet for introducing a fluid and proppant mixture under pressure into said chamber substantially along a path tangential to the side wall of the chamber, fluid extraction means comprising a reflux tube having one end positioned within said conical chamber for receiving fluid from said chamber and a second end communicating with a choke means, and an energy absorber means for receiving fluid from said choke means at high velocity and for dissipating said fluid velocity prior to discharging said fluid from said absorber means, said energy absorber means comprising a housing having an inner longitudinal tube with an inlet for receiving fluid therein and a closed end opposite said inlet, said inner tube having a plurality of apertures therethrough, said apertures being positioned closer to the inlet end then to said closed end, and an outer sleeve surrounding said inner tube to define an annular chamber therebetween and having an outlet therein remote from said apertures in said inner tube, and a plurality of baffles positioned in the annular chamber between said inner tube and said outer sleeve and positioned in the flow path between the apertures in said inner tube and the outlet in said sleeve.

6. The apparatus according to claim 5 wherein said baffles comprise a plurality of plates positioned around said inner tube and in the annular chamber between said inner tube and said outer sleeve, said plates having a plurality of apertures therethrough.

7. The apparatus according to claim 5 wherein said baffles include a plurality of plates mounted around said inner tube and within the annular chamber between said inner tube and said outer sleeve, said plates having a plurality of apertures substantially equally spaced around said inner tube.

8. An apparatus for concentrating the level of a proppant in a pressurized fluid mixture comprising:

a fluid chamber for receiving a pressurized fluid and proppant mixture therein and for discharging a concentrated fluid and proppant mixture therefrom, means for mixing said fluid and mixture such that fluid with a low concentration of proppant is maintained in one area in said fluid chamber, means for removing fluid from the low proppant concentration area of the fluid chamber and directing said fluid across a choke means to reduce the pressure of said fluid while maintaining the pressure of the fluid upstream, energy absorber means for receiving said fluid removed from said fluid chamber and for dissipating the kinetic energy of said fluid prior to discharging said fluid from said absorber means, said absorber means comprising a housing having an inner chamber with an inlet for receiving fluid therein and a closed end opposite said inlet, said inner chamber having a plurality of apertures therethrough, said apertures being positioned closer to the inlet than to the closed end, and an outer chamber surrounding said inner chamber to define an annular space therebetween and having an outlet therein remote from said apertures in said inner chamber.

9. The apparatus according to claim 8 wherein said inner chamber comprises:

an inner longitudinal tube with an inlet for receiving fluid therein and a closed end opposite said inlet, said inner tube having a plurality of apertures therethrough, said apertures being positioned closer to the inlet end than to said closed end, and wherein said outer chamber comprises an outer sleeve surrounding said inner tube to define an annular chamber therebetween and having an outlet therein remote from said apertures in said inner tube.

10. The apparatus according to claim 9 wherein said inner tube is concentric within said outer sleeve and wherein the outlet in said outer sleeve is adjacent the closed end of said inner tube.

11. The apparatus according to claim 9 wherein said apertures in said inner tube are formed adjacent the inlet of said inner tube and include a plurality of apertures spaced radially around said inner tube.

12. A fluid de-energizer comprising:

a housing having an inner longitudinal tube with an inlet for receiving pressurized fluid therein and a closed end opposite said inlet, said inner tube having a plurality of apertures therethrough, said apertures being positioned closer to the inlet end than to said closed end, and an outer sleeve surrounding said inner tube to define an annular chamber between said inner tube and said outer sleeve for receiving fluid into said chamber through said apertures in said inner tube and having an outlet therein remote from said apertures in said inner tube.

13. The apparatus according to claim 12 wherein said inner tube is concentric within said outer sleeve and wherein the outlet in said outer sleeve is adjacent the closed end of said inner tube.

14. The apparatus according to claim 12 wherein said apertures in said inner tube are formed adjacent the inlet of said inner tube and include a plurality of apertures spaced radially around said inner tube.

15. The apparatus for reducing the kinetic energy of a fluid comprising:

a housing having an inner chamber with an inlet for receiving pressurized fluid therein, said inner chamber having a plurality of apertures through the wall of said chamber, said apertures being positioned adjacent the inlet, and an outer chamber surrounding said inner chamber to define an annular space between said inner and outer chambers such that the annular space is in fluid communication with the apertures through said inner chamber, said outer chamber having an outlet therein remote from said apertures in said inner chamber.

16. The apparatus according to claim 15 wherein said inner chamber is concentric within said outer chamber.

17. An apparatus for separating a first fluid from a second fluid having a specific gravity greater than that of the first fluid comprising:

a fluid chamber for receiving a mixture of the first and second fluids under pressure, means for moving said mixture such that the second fluid is maintained in one area in said fluid chamber, means for removing said second fluid from the one area of the fluid chamber and directing said fluid across a choke means to reduce the pressure of said fluid while maintaining the pressure of the fluid upstream, and energy absorber means for receiving said fluid removed from said fluid chamber and for dissipating the kinetic energy of said fluid prior to discharging said fluid from said absorber means, said absorber means comprising a housing having an inner chamber with an inlet for receiving fluid therein and a closed end opposite said inlet, said inner chamber having a plurality of apertures therethrough, said apertures being positioned closer to the inlet than to the closed end, and an outer chamber surrounding said inner chamber to define an annular space therebetween and having an outlet therein remote from said apertures in said inner chamber.

18. The apparatus according to claim 17 wherein said inner chamber comprises:

an inner longitudinal tube with an inlet for receiving fluid therein and a closed end opposite said inlet, said inner tube having a plurality of apertures therethrough, said apertures being positioned closer to the inlet end than to said closed end, and wherein said outer chamber comprises an outer sleeve surrounding said inner tube to define an annular chamber therebetween and having an outlet therein remote from said apertures in said inner tube.

19. The apparatus according to claim 17 wherein said inner tube is concentric within said outer sleeve and wherein the outlet in said outer sleeve is adjacent the closed end of said inner tube.

20. The apparatus according to claim 17 wherein said apertures in said inner tube are formed adjacent the inlet of said inner tube and include a plurality of apertures spaced radially around said inner tube.

21. A method for concentrating the level of a proppant in a fluid under pressure comprising:

pumping the fluid and proppant mixture into a chamber such that an area of the chamber has fluid with a low proppant concentration, drawing fluid from the low proppant concentration area, directing said drawn fluid across a choke to reduce the pressure of the fluid and increase its velocity while maintaining the pressure of the fluid upstream, directing the high velocity fluid into an inner elongated chamber having an inlet, closed end opposite the inlet and apertures positioned closer to the inlet than to the closed end, directing said fluid through said apertures into a surrounding elongated chamber to an exhaust remote from said apertures.

22. An apparatus for concentrating the level of a proppant in a pressurized fluid mixture comprising:

a fluid chamber for receiving a pressurized fluid and proppant mixture therein and for discharging a concentrated fluid and proppant mixture therefrom, means for moving said fluid and mixture such that fluid with a low concentration of proppant is maintained in one area in said fluid chamber, means for removing fluid from the low proppant concentration area of the fluid chamber and directing said fluid across a choke means to reduce the pressure of said fluid, energy absorber means for receiving said fluid removed from said fluid chamber and for dissipating the kinetic energy of said fluid prior to discharging said fluid from said absorber means, said absorber means comprising a housing having an inner chamber with an inlet for receiving fluid therein and a closed end opposite said inlet, said inner chamber having a plurality of apertures therethrough, said apertures being positioned closer to the inlet than to the closed end, and an outer chamber surrounding said inner chamber to define an annular space therebetween and having an outlet therein remote from said apertures in said inner chamber, said inner chamber comprising an inner longitudinal tube with an inlet for receiving fluid therein and a closed end opposite said inlet, said inner tube having a plurality of apertures therethrough, said apertures being positioned closer to the inlet end than to said closed end, and wherein said outer chamber comprises an outer sleeve surrounding said inner tube to define an annular chamber therebetween and having an outlet therein remote from said apertures in said inner tube, and a plurality of baffles positioned in the annular chamber between said inner tube and said outer sleeve and positioned in the flow path between the apertures in said inner tube and the outlet in said sleeve.

23. The apparatus according to claim 22 wherein said baffles comprise a plurality of plates positioned around said inner tube and in the annular chamber between said inner tube and said outer sleeve said plates having a plurality of apertures formed therethrough.

24. A fluid de-energizer comprising:

a housing having an inner longitudinal tube with an inlet for receiving pressurized fluid therein and a closed end opposite said inlet, said inner tube having a plurality of apertures therethrough, said apertures being positioned closer to the inlet end than to said closed end, and an outer sleeve surrounding said inner tube to define an annular chamber between said inner tube and said outer sleeve for receiving fluid into said chamber through said apertures in said inner tube and having an outlet therein remote from said apertures in said inner tube, said inner tube being concentric within said outer sleeve and wherein the outlet in said outer sleeve is adjacent the closed end of said inner tube, and a plurality of baffles positioned in the annular chamber between said inner tube and said outer sleeve and positiond in the flow path between the apertures in said inner tube and the outlet in said sleeve.

25. The apparatus according to claim 24 wherein said baffles comprise a plurality of plates positioned around said inner tube and in the annular chamber between said inner tube and said outer sleeve, said plates having a plurality of apertures formed therethrough.

26. The apparatus for reducing the kinetic energy of a fluid comprising:

a housing having an inner chamber with an inlet for receiving pressurized fluid therein, said inner chamber having a plurality of apertures through the wall of said chamber, said apertures being positioned adjacent the inlet, and an outer chamber surrounding said inner chamber to define an annular space between said inner and outer chambers such that the annular space is in fluid communication with the apertures through said inner chamber, said outer chamber having an outlet therein remote from said apertures in said inner chamber, said inner chamber being concentric within said outer chamber, and a plurality of baffles positioned in the annular spaced between said inner chamber and said outer chamber and positioned in the flow path between the apertures in said inner chamber side wall and the outlet of said outer chamber.

27. An apparatus for separating a first fluid from a second fluid having a specific gravity greater than that of the first fluid comprising:

a fluid chamber for receiving a mixture of the first and second fluids under pressure, means for moving said mixture such that the second fluid is maintained in one area in said fluid chamber, means for removing said second fluid from the one area of the fluid chamber and directing said fluid across a choke means to reduce the pressure of said fluid, energy absorber means for receiving said fluid removed from said fluid chamber and for dissipating the kinetic energy of said fluid prior to discharging said fluid from said absorber means, said absorber means comprising a housing having an inner chamber with an inlet for receiving fluid therein and a closed end opposite said inlet, said inner chamber having a plurality of apertures therethrough, said apertures being positioned closer to the inlet than to the closed end, and an outer chamber surrounding said inner chamber to define an annular space therebetween and having an outlet therein remote from said apertures in said inner chamber, and a plurality of baffles positioned in the annular chamber between said inner tube and said outer sleeve and positioned in the flow path between the apertures in said inner tube and the outlet in said sleeve.

28. A method for concentrating the level of a proppant in a fluid under pressure comprising:

pumping the fluid and proppant mixture into a chamber such that an area of the chamber has fluid with a low proppant concentration, drawing fluid from the low proppant concentration area, directing said drawn fluid across a choke to reduce the pressure of the fluid and increase its velocity, directing the high velocity fluid into an inner elongated chamber having an inlet, a closed end opposite the inlet and apertures positioned closer to the inlet than to the closed end, directing said fluid through said apertures into a surrounding elongated chamber to an exhaust remote from said apertures, wherein a plurality of baffles are positioned in the surrounding elongated chamber in the flow path from the apertures in the inner elongated chamber and the exhaust of the surrounding elongated chamber.

29. The apparatus according to claim 26 wherein said baffles comprise:

a plurality of plates positioned around said inner chamber and in the annular space between said inner chamber and said outer chamber, said plates having a plurality of apertures formed therethrough.

* * * * *